US008276679B2

(12) United States Patent
Bui

(10) Patent No.: US 8,276,679 B2
(45) Date of Patent: Oct. 2, 2012

(54) ROOF TOP AND ATTIC VENT WATER MISTING SYSTEM

(76) Inventor: My Bui, San Diego, CA (US)

( * ) Notice: Subject to any disclaimer, the term of this patent is extended or adjusted under 35 U.S.C. 154(b) by 566 days.

(21) Appl. No.: 12/498,327

(22) Filed: Jul. 6, 2009

(65) Prior Publication Data

US 2011/0000142 A1 Jan. 6, 2011

(51) Int. Cl.

| | |
|---|---|
| ***A62C 35/15*** | (2006.01) |
| ***A62C 35/68*** | (2006.01) |
| ***A62C 35/00*** | (2006.01) |
| ***A62C 2/00*** | (2006.01) |
| ***A62C 3/00*** | (2006.01) |

(52) U.S. Cl. ..... 169/16; 169/9; 169/45; 239/208

(58) Field of Classification Search ..... 169/5, 9, 169/13, 16, 45; 239/208, 209, 373, 450, 239/DIG. 15

See application file for complete search history.

(56) References Cited

U.S. PATENT DOCUMENTS

| | | | | |
|---|---|---|---|---|
| 4,330,040 | A * | 5/1982 | Ence et al. | 169/13 |
| 5,125,458 | A * | 6/1992 | Berman | 169/16 |
| 5,727,350 | A * | 3/1998 | Marcella | 52/12 |
| 6,009,954 | A * | 1/2000 | Phillips | 169/16 |
| 6,189,805 | B1 | 2/2001 | West et al. | |
| 6,523,616 | B1 * | 2/2003 | Wallace | 169/70 |
| 7,137,269 | B1 | 11/2006 | Maranville | |
| 7,234,653 | B2 | 6/2007 | Powell et al. | |
| 7,334,744 | B1 | 2/2008 | Dawson | |
| 2008/0000649 | A1 | 1/2008 | Giurguis et al. | |

* cited by examiner

*Primary Examiner* — Darren W Gorman
(74) *Attorney, Agent, or Firm* — MDIP LLC

(57) ABSTRACT

The present invention describes systems and methods which provide a moisture barrier that douses or diffuses buoyant burning debris, particularly hot embers, from a bush and/or brush fire (e.g., wildfires). By strategic placement of the devices and/or apparatus as disclosed, a method of preventing the destruction of dwellings and roof-containing structures by exploiting heat convection is provided.

25 Claims, 6 Drawing Sheets

ROOF TOP AND ATTIC VENT WATER MISTING SYSTEM

BACKGROUND OF THE INVENTION

1. Field of the Invention

The present invention relates generally to fire prevention, and specifically to devices and methods for preventing the destruction of dwellings and other roof-containing structures from fires caused primarily from burning debris, especially embers from brush/bush fires, by co-segregation of atomized fluids and buoyant burning debris using perimeter fluid delivery and heat convection.

2. Background Information

Each year, the cycles of little rain followed by a long dry spell have lead to the accumulation of large amounts of dry brush and other vegetative combustibles. Under such conditions, dried trees and bushes become ideal fuel for wildfires. In regions with perennial dry seasons, these conditions produce fires that cause billions of dollars worth of damage.

With wildfires in the West seemingly becoming more frequent and destructive, there is a growing concern that climate change associated with global warming might be creating more fertile environments for these fires. In California, a major concern is centered on the effects of the Santa Ana winds. The Santa Ana winds are strong, extremely dry offshore winds that characteristically sweep through in Southern California and northern Baja California. They can range from hot to cold, depending on the prevailing temperatures in the Great Basin and upper Mojave Desert. However, the winds are noted most for the hot dry weather that they bring in autumn. With extremely low to no humidity and high temperatures, all that is necessary is a spark, and with the strong winds fanning the flames, in no time there is a full scale wildfire.

There is a widely held belief that fast moving wildfires explode houses into flames, burning them down in minutes, however, this not borne out by scientific observation. Typically, the majority of houses destroyed in wildfires actually survive the passage of the fire front, only to burn down from ignitions caused by buoyant burning debris. In fact, showers of burning debris may attack a building for some time before the fire front arrives, during the passage of the fire front and for several hours after the fire front has passed. This long duration of attack, to a large extent, explains why burning debris is a major cause of ignition of roof-containing structures.

Further, video footage of burning buildings caused by wildfires shows that a fire usually starts from the roofs and attics, then propagates downward to the support, and then collapses onto the lower section of the structure. The most common culprits for the observed vulnerability of roofed-structures are interstices between tiles and/or shingles and the openings for ventilation. These interstices and openings provide an entry path for flying embers to ignite structural items that make up the roof (i.e., plywood panels, support tresses, and felt liners), as well as fuels available in attics (e.g., old papers, clothing and the like).

While systems exist claiming to prevent fires on roof-containing structures, they all must be placed on or over the top or apex of the roof, and/or use copious amounts of water (see, e.g., U.S. Pat. Nos. 4,330,040; 5,263,543; 5,692,571; 6,679,337). What is needed is a system that douses embers as they enter interstices and openings available on roofs, which embers escape systems that provide water only in a downward direction along the slope of the roof via gravity. The present invention fulfills this need, and at the same time conserves water use.

SUMMARY OF THE INVENTION

The present invention describes devices and methods for preventing the destruction of dwellings and other roof-containing structures from fires caused primarily from burning debris, especially embers from brush/bush fires.

In one embodiment, a system is disclosed for protecting a roof-containing structure from fire embers including at least one fluid container having a first and second aperture, a first device that discontinuously increases the pressure of a gas above a fluid in the container by displacing or reducing gas volume, where the first device is configured to be in a passive feedback control loop through fluid communication with the container at the first aperture, and at least one lumen-containing conveyance in fluid communication with the second aperture, including one or more nodal points along the conveyance configured to include a second device at the nodal points, where the second device includes one or more atomizing orifices, where the conveyance is releasably coupled to an outer surface of the roof such that an atomized fluid delivered by the conveyance and buoyant fire embers co-segregate by way of heat convection. In a related aspect, the conveyance is releasably coupled to the outer surface along one or more gutters at the periphery of the roof, at one or more vents projecting from an upper surface of the roof, along one or more valleys of the roof or a combination thereof. In a further related aspect, the conveyance also includes a length which is devoid of nodal points, where the length is contained within a lumen of at least one downspout coupled to the gutters.

In one aspect, the passive feedback control loop includes a pressure regulator which is in electrical or mechanical communication with the first device and is coupled to the fluid container through the first aperture, and where the pressure regulator includes an actuator configured to control the on-off function of the first device. In a related aspect, the first device is mechanically automated or electrically automated. In a further related aspect, the first device is a pump or air-compressor.

In another aspect, the first device is in electrical communication with a rechargeable battery, where the battery is in electrical communication with a power source including one or more solar cells, one or more wind turbines, DC electrical power, AC electrical power, or a combination thereof.

In one aspect, the fluid container also includes a third and fourth aperture, which third aperture is coupled to a pressure relief valve, and which fourth aperture is configured to be in one-way fluid communication with a water supply separate from the container using a check valve. In another aspect, the conveyance is coupled to a separate local water supply at a distal end, and the coupled conveyance is configured to be in one-way fluid communication with the separate local water supply through a check valve, which check valve is proximal to the separate local water supply. In a related aspect, the coupled conveyance also includes a separate regulator in mechanical or electrical communication with the first device using an actuator, where the actuator is configured to control the on-off function of the first device.

In another embodiment, an apparatus is disclosed for protecting a roof-containing structure from fire embers including at least one fluid container having a first aperture, a first lumen-containing conveyance coupled to the first aperture, a second lumen-containing conveyance coupled to a separate local water supply, where the second conveyance is configured to be in one-way fluid communication with the separate local water supply using a check valve, and a third lumen-containing conveyance including one or more nodal points along the third conveyance configured to have a first device at the nodal points, where the first device includes one or more atomizing orifices, and where the first, second and third lumen-containing conveyances are in fluid communication through a first T-fitting connector.

In a related aspect, the apparatus also contains a first and second solenoid valve which flank two ends of the first T-fitting connector, where the first solenoid valve is in fluid communication with the first conveyance and the second solenoid is in fluid communication with the second conveyance, a pressure sensing valve which is above a third end of the first T-fitting connector which is in fluid communication with the third lumen-containing conveyance, and a telemetrically modulated second device in electrical communication with the first and second solenoid and the pressure sensing valve.

In one aspect, the third conveyance includes a length devoid of nodal points, which length includes a second T-fitting connector distal from the first T-fitting connector, where the second T-fitting connector is in fluid communication with two conduits, which two conduits comprise the one or more atomizing orifices. In a related aspect, the two conduits are configured to go along a face of the roof in parallel such that each first device forms an interdigitating lattice structure, where the orifices are distal relative to corresponding nodal points.

In one embodiment, a method of protecting a roof-containing structure from fire embers is disclosed including continuously delivering an atomized fluid proximally to an outer surface of the roof-containing structure through at least one lumen-containing conveyance configured to contain a plurality of atomizing orifices, where the conveyance is in fluid communication with at least one fluid source, and where the fluid is delivered under a pressure and at a fluid release rate such that the atomized fluid and buoyant fire embers co-segregate by way of heat convection.

In one aspect, the atomized fluid is continuously delivered through the orifices at a fluid release rate of between about 0.0084 to 0.023 gallons per minute (GPM). In another aspect, the atomized fluid is under a pressure of between about 18 and 24 psi. In a related aspect, the atomizing orifices are positioned on the outer surface at about 1 orifice per 10 square feet of roof surface. In a further related aspect, the overall fluid release rate over the outer surface of the roof is about 15 gallons per hour. In another related aspect, the pressure and fluid release rate are such that the fluid may be released over a period from about 0.5 to 8 hours.

In a further related aspect, the fluid comprises water.

BRIEF DESCRIPTION OF THE DRAWINGS

Exemplary embodiments of the present invention will hereinafter be described in conjunction with the appended drawing figures, wherein like numerals denote like elements.

DETAILED DESCRIPTION OF THE INVENTION

Before the present composition, methods, and methodologies are described, it is to be understood that this invention is not limited to particular components, methods, and apparatus described, as such components, methods, and apparatus may vary. It is also to be understood that the terminology used herein is for purposes of describing particular embodiments only, and is not intended to be limiting, since the scope of the present invention will be limited only in the appended claims.

As used in this specification and the appended claims, the singular forms "a", "an", and "the" include plural references unless the context clearly dictates otherwise. Thus, for example, references to "a valve" includes one or more valves, and/or components of the type described herein which will become apparent to those persons skilled in the art upon reading this disclosure and so forth.

Unless defined otherwise, all technical and scientific terms used herein have the same meaning as commonly understood by one of ordinary skill in the art to which this invention belongs. Any methods and materials similar or equivalent to those described herein can be used in the practice or testing of the invention, as it will be understood that modifications and variations are encompassed within the spirit and scope of the instant disclosure.

As used herein, "atomization," including grammatical variations thereof, means the conversion of a liquid into a spray of very fine droplets.

As used herein, "co-segregate," including grammatical variations thereof, means to migrate or move coordinately so as to separate or sequester jointly. For example, the fine droplets produced by atomization co-segregate with buoyant embers such that the embers are no longer available for combustion.

Figure 1:
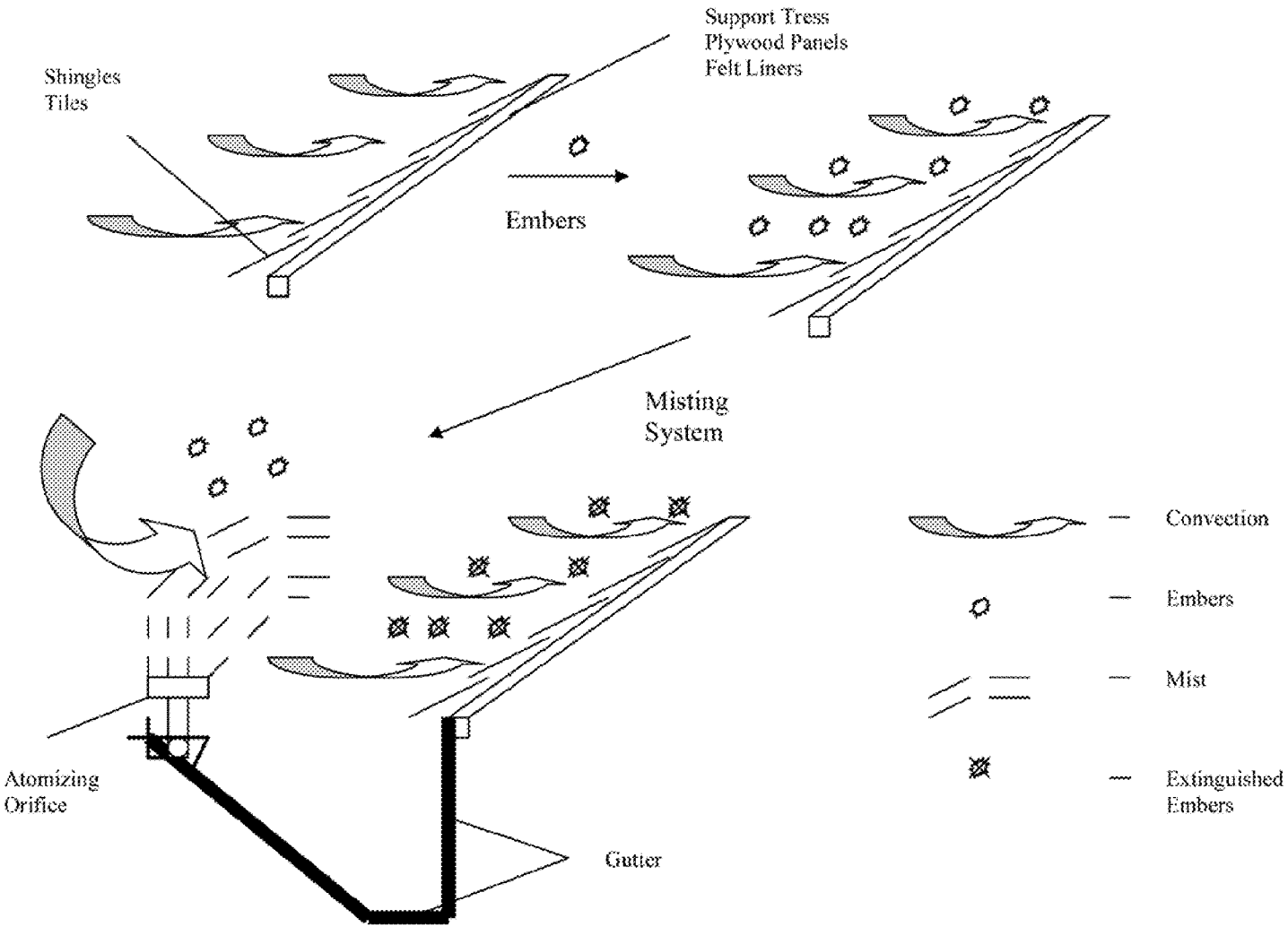
FIG. 1 illustrates how an atomized fluid carried by heat convection extinguishes buoyant embers.

With reference to the accompanying Figures, the present invention generally relates to devices and methods for preventing the destruction of dwellings and other roof-containing structures from fires caused primarily from burning debris, especially embers from brush/bush fires. FIG. 1 illustrates that embers that become buoyant by convection land within interstices present on the roof, thus they are capable of igniting materials contained therein (e.g., wood making up the support tresses, plywood panels, felt liners and the like). The system and apparatus of the present invention produce atomized droplets of fluid which float with the embers and are thus deposited with them as a function of heat convection, thereby preventing ignition of combustible materials by extinguishing the embers prior to, concomitant with, and/or subsequent to contact with such interstices.

Figure 2:
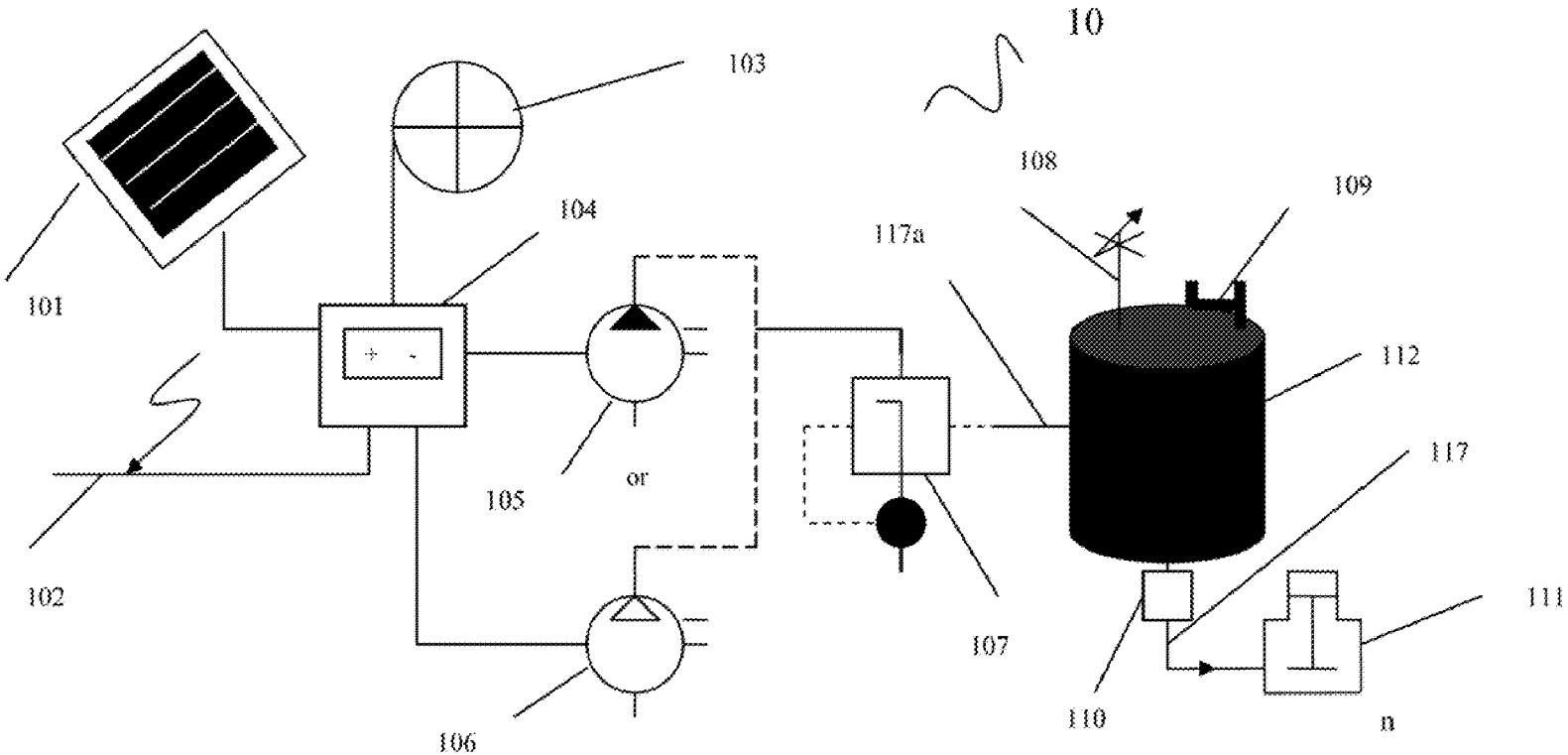
FIG. 2 shows the components of the present invention as described.

FIG. 2 illustrates a system 10 for protecting a roof-containing structure from fire embers. In FIG. 2, the fluid container 112 comprises at least two apertures for ingress 117*a* and egress 117 of fluids. Further, the container 112 is pressurizable, and may be portable or stationary, depending on the amount of fluid to be contained therein. In one aspect, the container 112 may accommodate about 10 to 20 gallons of liquid, about 20 to 50 gallons of liquid, about 50 to 75 gallons of liquid, or greater than about 100 gallons of liquid. In a related aspect, the container 112 contains at least 50 gallons of water.

The container 112 may be made of plastic or metal and/or any other material that allows for containment of multiple gallons of a fluid with at least the density of water, and that allows for pressurization of at least 60 psi. In one embodiment, the fluid comprises water, however, any atomizable fire-suppressant fluid may be used in the present invention. For example, fluids may be water or water-based mixtures, including but not limited to cellulose, water and ammonia; water, camphor, and ammonium chloride; hydroxyl ammonium nitrate, an amine nitrate salt, and water and the like.

The container 112 may contain one or more additional apertures to accommodate a pressure relief valve 108 and/or an additional water inlet 109. The container 112 is configured to be communication with a first device 105 or 106 that discontinuously increases the pressure of a gas above a liquid or other fluid by displacing (pump 105) or reducing (compressor 106) gas volume. The first device 105/106 is controlled by a passive feedback control loop via fluid communication with a pressure regulator 107 between the first device 105/106 and the container 112. The first device 105/106 may be an electrically or mechanically automated machine which provides discontinuous, intermittent airflow into the fluid container 112 via a pressure regulator 107 in a passive feedback-control loop configuration. This regulator 107 operates the system in a highly efficient manner, since the loop configuration does not require continuous power consumption by the first device 105/106 for pressure modulation control in the container 112 after the system 10 is activated. For example, when the egress pressure from the container 112 reaches a specific value (e.g., 24 psi) the feedback loop shuts off the first device 105/106, and when the egress pressure from the container 112 goes below 24 psi, the first device 105/106 is activated.

In a preferred embodiment, the first device 105/106 is electrically automated. In one aspect, the fluid is delivered under a pressure of about 15 to 18 psi, about 18 to 20 psi, about 20 to 22 psi, or about 22 to 24 psi. In another aspect, the fluid is delivered tinder a pressure of about 18 to 24 psi.

The embodiment shown in FIG. 2 also includes a rechargeable battery 104 which is configured to be in electrical communication with an AC/DC power source 102 (e.g., but not limited to, a wall outlet or a generator), a solar source 101, or wind turbine 103 or a combination thereof.

The container 112 is also coupled to a lumen containing conveyance 117 (e.g., a hose, pipe or other fluid transfer conduit for directing the flow of liquids) which may comprise plastic, rubber, cloth, metal, fire resistant material or a combination thereof. Such a conveyance may comprise a valve 110 (manual or automatic) for regulating liquid egress from the container 112. Further, the conveyance 117 contains a plurality of nodal points (n) along its length, where such nodal points contain a second device 111. The second device 111 transforms the incoming pressure to a higher second pressure such that a liquid delivered by the conveyance 117 is converted into a spray of very fine droplets (i.e., an atomizing orifice; for example, but not limited to, a nozzle or mister). In one aspect, such a second device 111 has a fluid release rate of about 0.0083 to 0.0090 gallons per minute (GPM), about 0.0090 to 0.0100 GPM, about 0.0100 to 0.0150 GPM, about 0.0150 to 0.020 GPM, and from about 0.020 to 0.024 GPM. In another aspect, the fluid release rate is about 0.0084 to 0.023 GPM. The conveyance 117 may be of any length, and may contain lengths devoid of nodal points (n) to allow for distal placement of the second device 111.

The system 10 may also comprise gauges and additional valves to monitor and effect fluid flow. In one aspect, the system 10 is activated manually prior to leaving a home or other roof-containing structure once a wildfire emergency has been declared. In another aspect, the system 10 may be activated remotely if a user is notified away from a dwelling or other roof-containing structure that such an emergency exists. Further, automatic activation may be actuated by smoke detection, fire detection, or other external-environment based detection systems.

Figure 3:
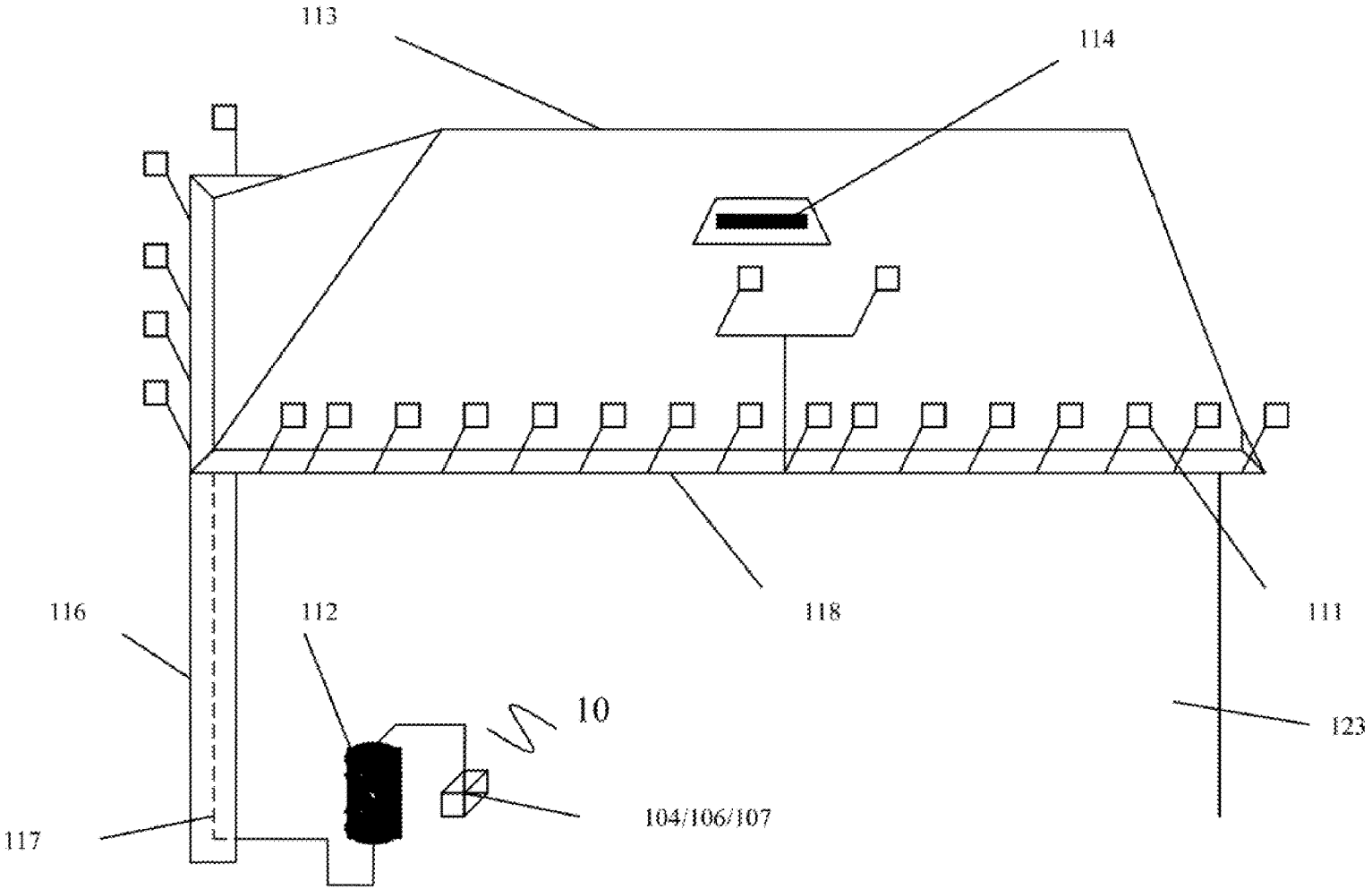
FIG. 3 shows an embodiment of the present invention positioned on the roof of a dwelling as disclosed.

FIG. 3 shows the system 10 where the orifices 111 are strategically placed on the roof 113 and at a vent 114 of a dwelling by running the conveyance 117 up a downspout 116 and along the gutters 118 of the dwelling (e.g., at the bottom of the roof-line or at the drip edge). In this embodiment, such placement maximizes the exploitation of air flow produced by heat to drive a misting fluid with any buoyant embers along the face of the roof 113. Thus, the positioning as illustrated achieves the co-segregation of the atomized fluid with buoyant embers such that the embers are no longer available for combustion. Such exploitation is not possible where release of the liquid is only from the top or apex of the roof 113 (i.e., heat convection would blow released fluids away from the structure). In one aspect, the orifices 111 are strategically placed such that they face a wind moving from east to west. In another aspect, the orifices 111 may be coupled to servos or other mechanical devices such that the orifices 111 may be repositioned automatically/remotely to take advantage of wind direction.

The embodiment of FIG. 3 also illustrates the placement of the orifices 111 in front of any vents 114 which project from the surface of the roof 113 for protection against embers potentially entering the attic.

Figure 4:
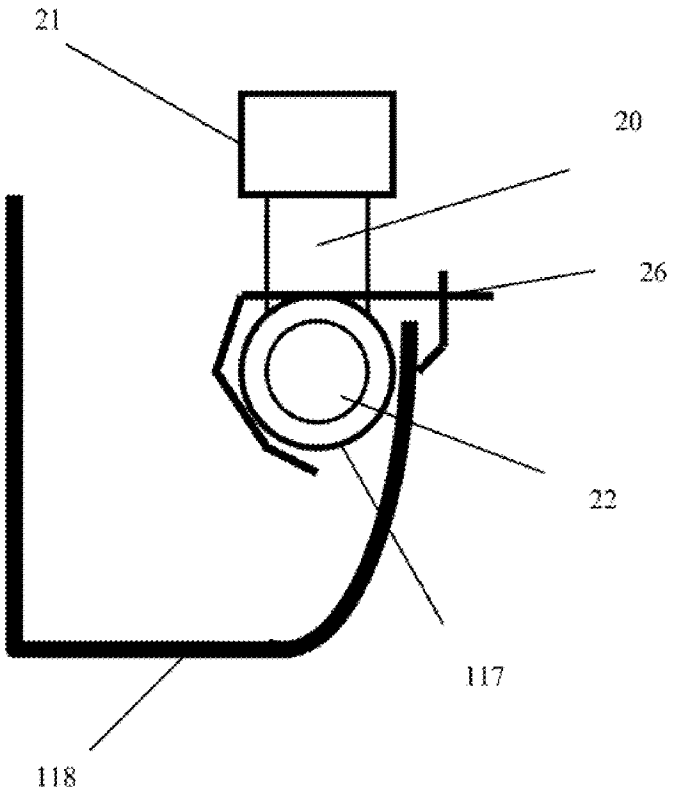
FIG. 4 shows an atomizing orifice of the present invention, including a preferred embodiment as disclosed.
Figure 4:
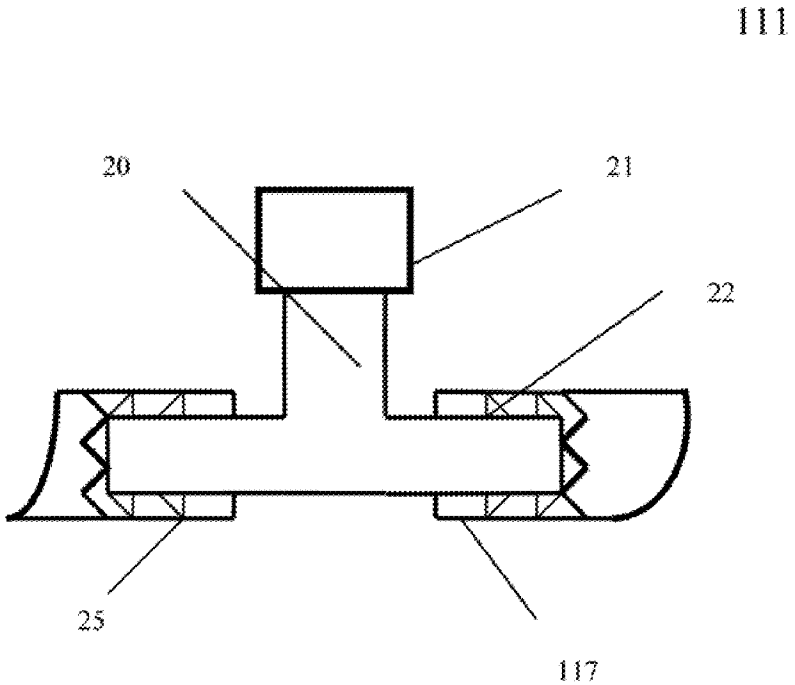

FIG. 4 shows a detailed illustration of an atomizing orifice 111. As seen in the figure, the orifice has three main components; a nozzle head 21, a first conduit 20 perpendicular to the flow line of the conveyance 117 and a second conduit 22 integral with the perpendicular conduit and that is parallel with the flow line of the conveyance 117. As the system 10 is closed and under pressure, fluid can only escape through the orifices 111.

The nozzle head 21 may be made from any material, including but not limited to, metal, plastic, rubber or a combination thereof. Such nozzles are commercially available (see, e.g., Ecologic Technologies, Pasadena, Md.), and come in a wide variety of colors, angles and GPM rates. In one aspect, the angle of the orifice is about 115° or about 180°.

The first perpendicular conduit 20 may be of any length, such that nozzle 21 height provides a sufficient atomized liquid canopy for co-segregation via heat convection. The integral second parallel conduit 22 also contains protuberances 25 on its outer surface which produce an air-tight/water-tight seal against the inner lumen of the conveyance 117. FIG. 4 also shows an orifice 111 attached to a gutter 118 via a releasable mechanism 26 (e.g., including, but not limited to a clip).

Figure 5:
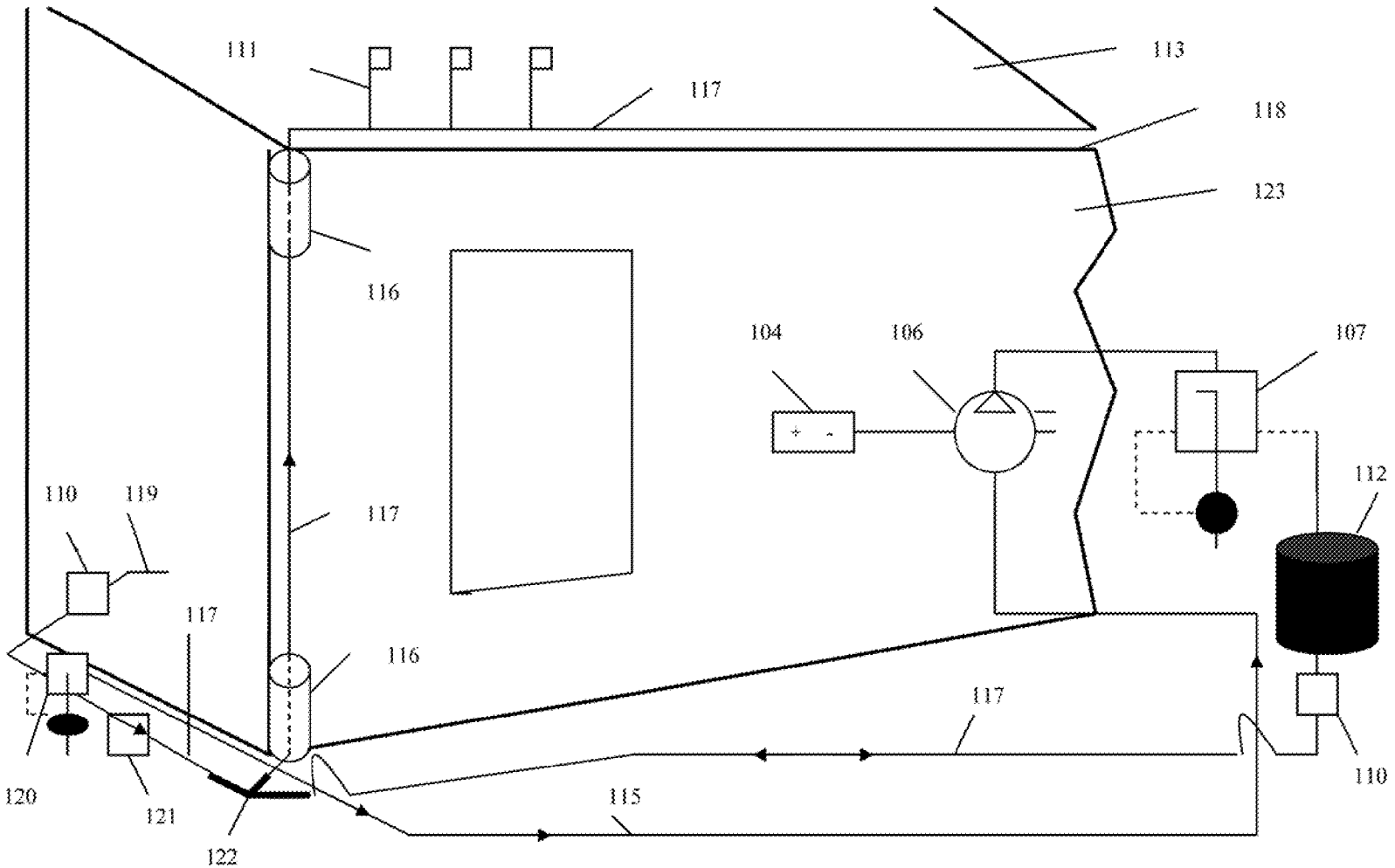
FIG. 5 shows another embodiment of the present invention positioned on the roof of a dwelling as disclosed.

FIG. 5 shows an embodiment of the present invention comprising more than one source of fire suppressant (e.g., water or fire retardant liquid). In this embodiment, water, for example, may be obtained from either the container 112 or from a municipal/household source 119. Fluid flow from the container 112 and municipal source 119 may be effected by manual control valves 110; however, when the system 10 is under automated control, separate systems become active (110 valves would remain open). Under automated control, flow from the municipal source 119 is controlled by an actuator 120 (which is in fluid communication with the municipal source 119 and in electrical communication with the first device 106) and a check valve 121 to ensure one way fluid communication from the municipal source 119. The conveyance 117 from the municipal source 119 is in fluid communication with a T-fitting connector 122 (although a T-fitting connector is described, one of skill in the art would understand that any connector comprising at least three flow paths will be useful for the present embodiment as disclosed). When, for example, water pressure is low from this source 119 (e.g., over use of municipal source during wildfire), the actuator will shut-off flow from the municipal source 119 and engage flow from the container 112 via activation of the first device 106 (e.g., when pressure from 119 is less than 25 psi), as the actuator 120 is in electrical communication with the first device 106 through an electrical conduit 115. Flow from the container 112 is the same as described above, except that the conveyance 117 is coupled to the common T-fitting connector 122. If the container 112 is emptied, and municipal flow 119 is available, the first device 106 will shut-off, and the actuator 120 will engage flow from the municipal source 119, including reversing flow through the conveyance 117 to fill the container using the municipal source 119 (e.g., when pressure from municipal source 119 is greater than 40 psi).

Figure 6:
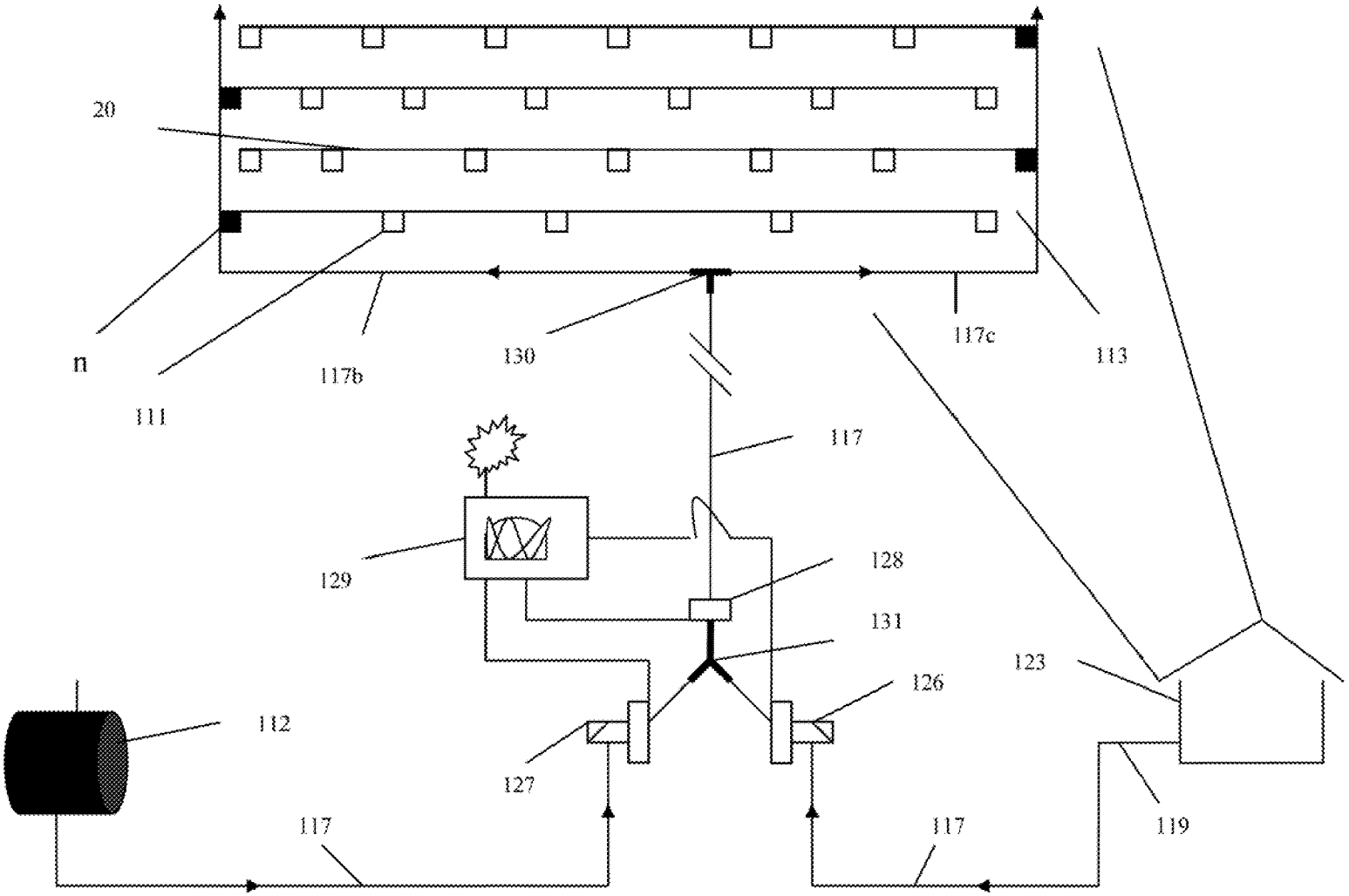
FIG. 6 shows a variation of the embodiment of the invention as illustrated in FIG. 5.

FIG. 6 illustrates a variation of the separate source embodiment of FIG. 5. In this embodiment, the fluid flow from the two sources (112, 119) is controlled by a pressure sensor 128, a first 126 and second 127 solenoid, and a control module 129 which may be monitored and managed telemetrically. Under automated control and after the system is activated, the control module 129 acquires data from the pressure sensor 128 and relays that data to a user. If the pressure changes for one fluid source or the other, the user may then switch sources by manipulating the solenoids 126, 127 remotely. As shown in the figure, the pressure sensor 128 and solenoids 126, 127 are in fluid communication via a tripartite valve 131 (again, one of skill in the art would understand that any connector comprising at least three flow paths will be useful for the present embodiment as disclosed), and are in electrical communication with the control module 129. Also shown is a positioning of the nodal containing conveyance 117 in a parallel lattice formation along the face of a roof 113. To achieve the lattice, the conveyance 117 is split into two flow paths (117*b*, 117*c*) via a T-fitting connector 130, and is then configured to go along the roof surface 113 in parallel. The orifices 111 are contained on long first perpendicular conduits 20 and interdigitate as they project from opposite nodal points (n). Alternatively, perpendicular conveyances 117 containing a plurality of nodal points (n) comprising multiple orifices 111 in fluid communication via multiple T-fitting connectors 130 may be used. This pattern may be useful when greater coverage on larger roof surfaces is required (e.g., a warehouse or mansion).

Although the invention has been described with reference to the above embodiments, it will be understood that modifications and variations are encompassed within the spirit and scope of the invention.

All references cited herein are herein incorporated by reference in their entirety.

I claim herein:

1. A system for protecting a roof-containing structure from fire embers comprising:

a) at least one fluid container comprising a first second, third and fourth aperture, which third aperture is coupled to a pressure relief valve, and which fourth aperture is configured to be in one-way fluid communication with a water supply separate from said at least one fluid container via a check valve;

b) a first device that discontinuously increases the pressure of a gas above a fluid in said at least one fluid container by providing airflow into said at least one fluid container, wherein said first device is configured to be in a passive feedback control loop via fluid communication with said at least one fluid container at said first aperture; and c) at least one lumen-containing conveyance in fluid communication with said second aperture comprising one or more nodal points along said at lease one lumen-containing conveyance which comprises a second device at said one or more nodal points, wherein said second device comprises one or more atomizing orifices, wherein said at least one lumen-containing conveyance is releasably coupled to an outer surface of said roof-containing structure such that an atomized fluid delivered by said at least one lumen-containing conveyance and buoyant fire embers co-segregate via heat convection.

2. The system of claim 1, wherein the passive feedback control loop comprises a pressure regulator which is in electrical or mechanical communication with said first device and is coupled to said at least one fluid container via said first aperture, and wherein said pressure regulator comprises an actuator configured to control the on-off function of said first device.

3. The system of claim 2, wherein said first device is mechanically automated.

4. The system of claim 2, wherein said first device is electrically automated.

5. The system of claim 4, wherein said first device is in electrical communication with a rechargeable battery.

6. The system of claim 5, wherein said battery is in electrical communication with a power source selected from the group consisting of at least one solar cell, at least one wind turbine, DC electrical power, AC electrical power, and a combination thereof.

7. The system of claim 1, wherein said first device is a pump or air-compressor.

8. The system of claim 1, wherein said at least one lumen-containing conveyance is coupled to a separate local water supply at a distal end, and wherein said coupled at least one lumen-containing conveyance is configured to be in one-way fluid communication with said separate local water supply via a check valve, which check valve is proximal to said separate local water supply.

9. The system of claim 8, wherein said coupled at least one lumen-containing conveyance further comprises a separate regulator in mechanical or electrical communication with said first device via an actuator, wherein said actuator is configured to control the on-off function of said first device.

10. The system of claim 1, wherein said at least one lumen-containing conveyance is releasably coupled to said outer surface of said roof-containing structure: i) along one or more gutters at the periphery of said roof-containing structure; ii) at one or more vents projecting from an upper surface of said roof-containing structure; iii) along one or more valleys of said roof-containing structure; or iv) a combination of (i), (ii), and (iii).

11. The system of claim 10, wherein said at least one lumen-containing conveyance further comprises a length which is devoid of nodal points, and wherein said length is contained within a lumen of at least one downspout coupled to said gutters.

12. An apparatus for protecting a roof-containing structure from fire embers comprising:

a) at least one fluid container comprising a first aperture;

b) a first lumen-containing conveyance coupled to said first aperture;

c) a second lumen-containing conveyance coupled to a separate local water supply, wherein said second lumen-containing conveyance is configured to be in one-way fluid communication with said separate local water supply via a check valve;

d) a third lumen-containing conveyance comprising one or more nodal points along said third lumen-containing conveyance which comprises one or more atomizing orifices at said nodal points, wherein said first, second and third lumen-containing conveyances are in fluid communication via a first T-fitting connector;

e) a first and second solenoid valve which flank two ends of said first T-fitting connector, wherein said first solenoid valve is in fluid communication with said first lumen-containing conveyance and said second solenoid valve is in fluid communication with said second lumen-containing conveyance;

f) a pressure sensing valve which is above a third end of said first T-fitting connector which is in fluid communication with said third lumen-containing conveyance, and g) a telemetrically modulated control module in electrical communication with said first and second solenoid and said pressure sensing valve.

13. The apparatus of claim 12, wherein said at least one fluid container is a pressurized tank comprising water.

14. The apparatus of claim 12, wherein said at least one fluid container comprises a second aperture, wherein said apparatus further comprises a pump or air-compressor that discontinuously increases the pressure of a gas above a fluid in said at least one fluid container by providing airflow into said at least one fluid container, and wherein said pump or air-compressor is configured to be in a passive feedback control loop via fluid communication with said at least one container at the second aperture.

15. The apparatus of claim 12, wherein said third lumen containing conveyance comprises a length devoid of nodal points, which length comprises a second T-fitting connector distal from the first T-fitting connector, wherein said second T-fitting connector is in fluid communication with two conduits, which two conduits comprise said one or more atomizing orifices.

16. The apparatus of claim 15, wherein said two conduits are configured to go along a face of said roof-containing structure in parallel such that the conduits and said one or more atomizing orifices form an interdigitating lattice structure, wherein said orifices are distal relative to corresponding nodal points.

17. A method of protecting a roof-containing structure from fire embers comprising:

placing the apparatus of claim 1 on said roof-containing structure; and continuously delivering an atomized fluid proximally to said outer surface of said roof-containing structure through said at least one lumen-containing conveyance which contains a plurality of said one or more atomizing orifices, wherein said fluid is delivered under a pressure and at a fluid release rate such that the atomized fluid and buoyant fire embers co-segregate via heat convection.

18. The method of claim 17, comprising continuously delivering the atomized fluid through said orifices at a fluid release rate of between about 0.0084 to 0.023 GPM.

19. The method of claim 18, comprising continuously delivering the atomized fluid under a pressure of between about 18 and 24 psi.

20. The method of claim 17, further comprising releasably coupling said at least one lumen-containing conveyance to said outer surface: i) along one or more gutters at the periphery of said roof-containing structure; ii) at one or more openings at vents projecting from an upper surface of said roof-containing structure; iii) along one or more valleys of said roof-containing structure; or iv) a combination of (i), (ii), and (iii).

21. The method of claim 19, wherein said atomizing orifices are positioned on said outer surface at about 1 orifice per 10 square feet of roof surface.

22. The method of claim 21, wherein the overall fluid release rate over the outer surface of said roof is about 15 gallons per hour.

23. The method of claim 22, wherein said pressure and fluid release rate are such that said fluid is released over a period from about 0.5 to 8 hours.

24. The method of claim 19, wherein the fluid comprises water.

25. A method of protecting a roof-containing structure from fire embers comprising:

placing the apparatus of claim 12 on said roof-containing structure; and continuously delivering an atomized fluid proximally to an outer surface of said roof-containing structure through said third lumen-containing conveyance which contains a plurality of said one or more atomizing orifices, wherein said fluid is delivered under a pressure and at a fluid release rate such that the atomized fluid and buoyant fire embers co-segregate via heat convection.

* * * * *